United States Patent [19]

Nawman

[11] 4,265,499

[45] May 5, 1981

[54] PROTECTIVE TELEPHONE STAND

[75] Inventor: Rollie B. Nawman, Pleasant Hill, Calif.

[73] Assignee: Benner-Nawman, Inc., Pleasant Hill, Calif.

[21] Appl. No.: 70,970

[22] Filed: Aug. 30, 1979

[51] Int. Cl.[3] ..... A47B 81/06

[52] U.S. Cl. ..... 312/100; 312/33; 312/295

[58] Field of Search ..... 312/33, 42, 45, 100, 312/242, 245, 270, 295; 49/40, 70; 52/245

[56] References Cited

U.S. PATENT DOCUMENTS

| | | | |
|---|---|---|---|
| 1,924,365 | 8/1933 | Mariotti | 312/33 |
| 2,000,920 | 5/1935 | Campbell | 312/265 |
| 2,905,518 | 9/1959 | Doeskin | 49/40 |
| 2,982,593 | 5/1961 | Chambers | 312/100 |

FOREIGN PATENT DOCUMENTS

| | | | |
|---|---|---|---|
| 86892 | 12/1955 | Norway | 312/100 |

*Primary Examiner*—Casmir A. Nunberg

*Attorney, Agent, or Firm*—Harris Zimmerman; Howard Cohen

[57] ABSTRACT

A protective telephone stand includes an upwardly extending tubular base member having a horizontal shelf member secured to the upper end thereof. A pipe section is secured atop the shelf member co-axially with the support member, and is provided with a large opening in the side wall thereof. A fixed support frame is secured within the pipe section to support a telephone unit, and a curved door having approximately the same radius of curvature as the pipe section is pivotally supported in the pipe section. A rod extends through the fixed frame, the support for the pivotting door, the shelf member, and the tubular support member to join the entire assembly together. The telephone is displayed in the opening in the pipe section, and the door may be pivoted shut and locked to protect the telephone unit.

6 Claims, 9 Drawing Figures

PROTECTIVE TELEPHONE STAND

BACKGROUND OF THE INVENTION

The following United States patents comprise the closest known prior art:

| | |
|---|---|
| 1,424,863 | 1,702,178 |
| 1,944,430 | 2,028,627 |
| 2,028,628 | 2,493,947 |
| 3,305,284 | |

Most public telephones are displayed for public use in telephone booths or telephone stands, the latter being generally characterized as having no enclosure to surround the user of the telephone. Indeed, it appears that telephone stands are being used increasingly to display public telephones, as they are far less expensive than telephone booths.

There has been a trend in recent years toward an increase in vandalism perpetrated on public telephones. Some of the vandalism appears to express an increasing public antagonism toward the telephone monopoly, but most of the vandalism appears to be carried out in the act of burglarizing the pay telephone to obtain the contents of the coin box. Generally speaking, these acts of vandalism are carried out when as few witnesses as possible are nearby; for example, during late evening and early morning hours when few persons are about.

There are known in the prior art various protective enclosures for telephonic communications equipment, many of them being associated with police or fire fighting communications. These enclosures are generally expensive to fabricate, and are not well suited for displaying public pay telephones. Indeed, secure prior art enclosures are far too expensive to be used widely for public telephones.

SUMMARY OF THE PRESENT INVENTION

The present invention generally comprises a telephone stand for displaying a telephone instrument for public use. Its most salient characteristic is that it provides a secure, lockable enclosure for the telephone instrument. It is also easy and inexpensive to manufacture, sturdy and virtually maintenance free.

The telephone stand includes a tubular base member which may be fabricated from a section of steel pipe or the lake. The base member rests on a flared footing, and has secured to its upper end a laterally extending shelf member.

Secured co-axially to the base member and resting on the shelf member is an upper pipe section which forms the actual enclosure for the telephone instrument. A large rectangular window is cut in the side wall of the upper pipe member to provide access to the telephone. A curved door is disposed within the upper pipe section, and includes laterally extending pivot brackets secured thereto. A support member is also secured within the upper pipe member to support and retain the telephone instrument. A long threaded rod extends through the support member, the lower pivot bracket of the door, the shelf member, and the base member to the footing, securing all of these members together.

The curved door is a section of a cylinder, and is provided with a radially outwardly extending flange at the leading vertical edge thereof. Locking means associated with the flange permits the door to be locked in the fully open or fully closed position. In the open position, the telephone is available for public use. With the door pivotted shut and locked, the telephone is completely protected from vandalism and malicious mischief.

DESCRIPTION OF THE PREFERRED EMBODIMENT

The present invention generally comprises a telephone stand for displaying a telephone for public use as well as protecting the telephone from vandals, burglars, and the like. The telephone stand is formed substantially entirely of sections of metal pipe, such as steel pipe, the pipe sections providing high structural strength as well as a weatherproof and intrusion-proof enclosure.

Figure 1:
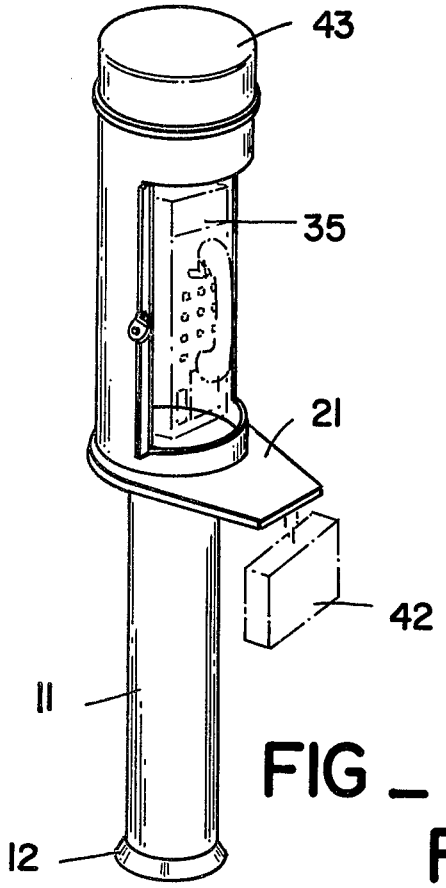
FIG. 1 is a perspective view of the telephone stand of the present invention, shown in the open disposition.
Figure 2:
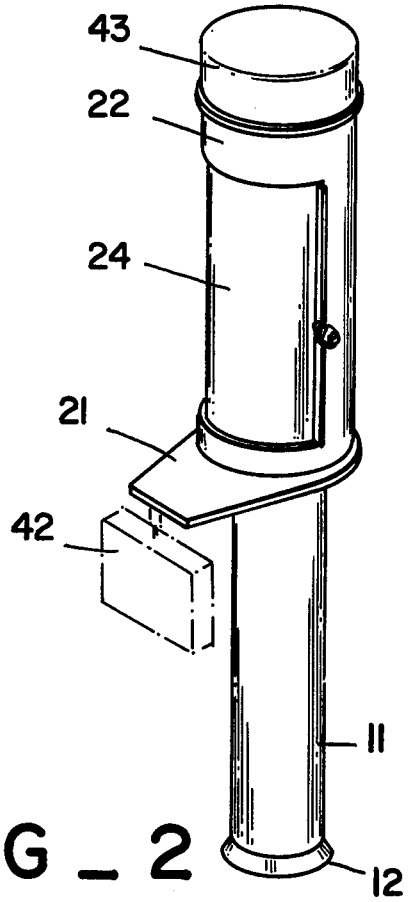
FIG. 2 is a perspective view of the telephone stand shown in the closed and locked position.
Figure 9:
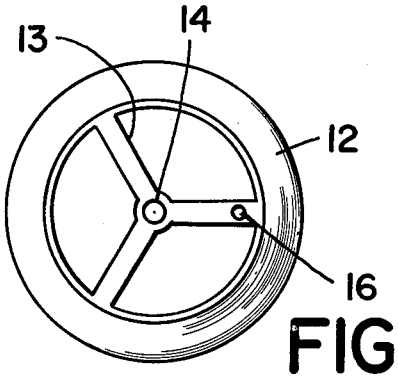
FIG. 9 is a top view of the footing of the present invention.
Figure 5:
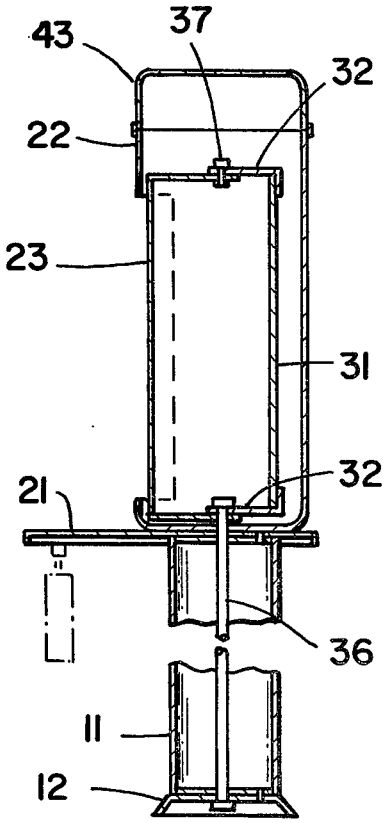
FIG. 5 is a cross-sectional elevation of the telephone stand of the present invention.

With reference to FIGS. 1, 2, and 5, the telephone enclosure includes a tubular base member 11 extending upwardly and supported by a footing 12. With reference to FIG. 9, the footing 12 includes an upwardly tapering truncated conical member having a spider 13 secured in the hollow central portion thereof. The spider 13 includes an axially disposed hole 14 and an pilot hole 16 in the radially distal portion of one of the arms of the spider.

Figure 8:
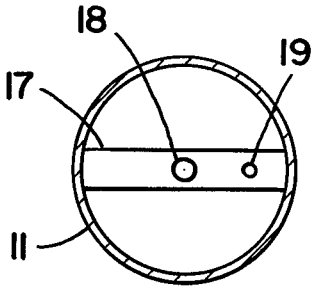
FIG. 8 is a cross-sectional view of the base member of the present invention.

With reference to FIG. 8, a strap 17 extends diametrically across the lower end of the base member 11. The strap 17 includes an axially disposed hole 18, and a pilot hole 19 which is radially spaced from the hole 18 the same distance as the hole 16 is spaced from the axial hole 14.

Figure 3:
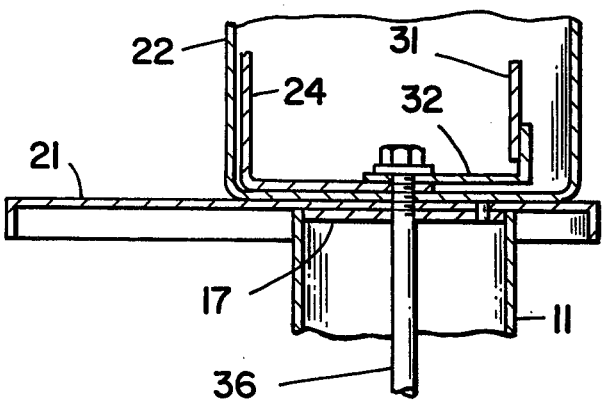
FIG. 3 is an enlarged cross-sectional elevation showing the assembly of the upper and base members of the present invention.

A strap 17 is also secured in the upper end of the tubular base member 11, as shown in FIG. 3. Secured directly atop the upper end of the base member 11 is a shelf member 21. The shelf member is slightly larger in width than the diameter of the member 11, and the length of the shelf member 21 is substantially greater than the diameter of base member 11. The shelf member also includes a hole therein which is axially aligned with the holes 18 of the straps 17 and the hole 14 of the spider 13. Secured directly atop the shelf member 21 and disposed concentrically with respect to the base member 11 is an upper tubular member 22. Both the members 11 and 22 may be formed in the preferred embodiment of steel pipe sections, the member 11 having a diameter slightly smaller than the diameter of member 22.

The upper tubular member 22 is provided with a large rectangular window 23 in the side wall thereof, the window 23 subtending an angle slightly less than 180° and extending longitudinally a substantial amount of the axial dimension of the member 22.

Figure 4:
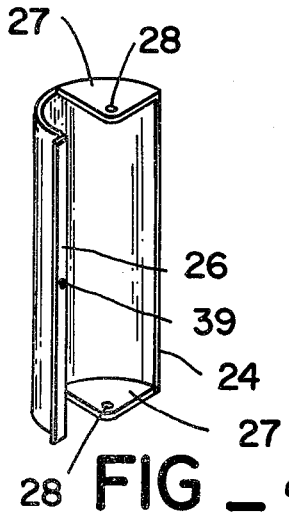
FIG. 4 is a perspective view of the door assembly of the present invention.

A curved door 24 is disposed within the upper section 22 and adapted to close the window 23. With reference to FIG. 4, the door 24 comprises a cylindrical pipe section slightly longer than the axial extent of the window 23 and subtending an angle slighlty larger than that of the window 23. A flange 26 is secured to the leading vertical edge of the door 24. A pair of pivotting brackets 27 are secured to opposed ends of the door 24 and extend generally radially inwardly therefrom. The brackets 27 are provided with holes 28 which are disposed coaxially with the holes 18 and 14.

Also disposed within the member 22 is a support assembly for supporting and securing the telephone instrument. With reference to FIGS. 3, 5, 6, and 7, the support assembly includes a generally outwardly extending support panel 31 having arms 32 extending laterally from opposed ends thereof. The support arms 32 extend generally along the same radius of the member 22, and are provided with holes 33 extending coaxially with the holes 18 and 14. The panel 31 may be provided with bolt holes, brackets, or the like for securing and retaining the telephone instrument 35, as shown in FIG. 1.

The present invention includes a tie rod 36 which serves the function of joining the parts of the telephone enclosure in a simple but rugged assembly. With reference to FIGS. 3 and 5, the tie rod 36 extends through the hole 33 of the lower arm 32, through the hole 28 of the pivotting bracket 27, the hole in the shelf member 21, the holes 18 in the straps 17, and through the hole 14 in the spider 13. The lower end of the rod 36 is threaded to receive a nut, the compression provided by the threaded engagement maintaining the assembly of the mounting bracket, the pivotting door, the upper member 22, the shelf member 21, the base member 11, and the footing 12. Pins may be provided to extend through the pilot holes 16, 19, and the like, to prevent relative rotation of the members 11, 21, and 22.

Figure 7:
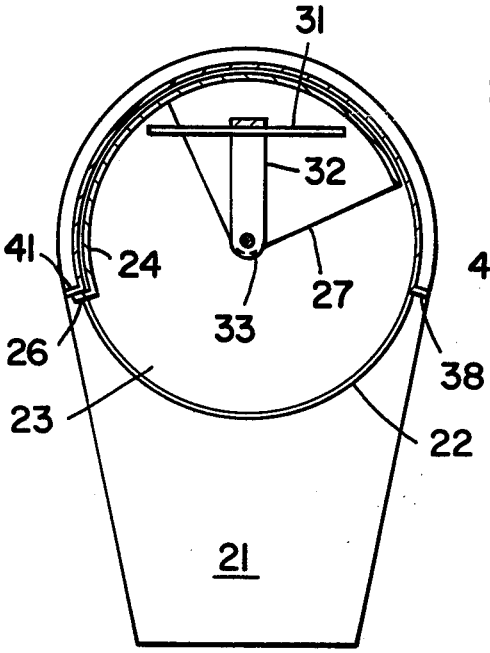
FIG. 7 is a horizontal cross-sectional view of the telephone stand, shown in the open disposition.
Figure 6:
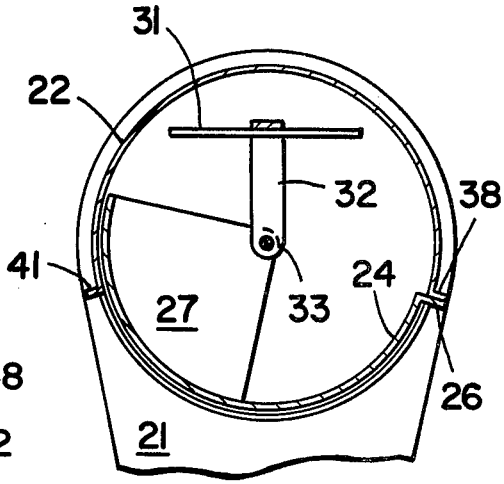
FIG. 6 is a cut-away top view of the telephone stand of the present invention, shown in the closed disposition.

The upper arm 32 is joined to the upper bracket 27 by means of a nut and bolt assembly 37, so that the upper end of the door 24 may be pivotally supported with respect to the rest of the enclosure. With reference to FIGS. 6 and 7, one edge of the window 23 is provided with an outwardly extending flange 38. When the door 24 is pivotted to close the window 23, the flange 26 of the door 24 abuts the flange 38 secured to the member 22. Both flanges 26 and 38 are provided with aligned holes 39 through which the shackle of a lock may be secured. A similar flange 41 is secured to the other vertical edge of the window 23, and is also provided with a hole to receive a shackle of a lock. Thus the door 24 may be locked in the fully opened position (to flange 41), or in the fully closed position (to flange 38). The shelf member 21 is provided below the telephone to support packages, coins for the pay phone 35, or the like. The shelf 21 also supports a subjacently depending telephone book holder 42, shown in phantom in FIGS. 1 and 2. The telephone book holder 42 is disclosed in U.S. Pat. Nos. 3,791,677, and 3,860,212, both patents issued to Rollie Nawman. Suffice it to say that the telephone book holders 42 are adapted to pivot to present a telephone book superjacently of the shelf 21 and supported thereby.

Secured to the upper open end of the member 22 is a cylindrical dome 43, as shown in FIGS. 1, 2, and 5. The dome 43 may be formed of translucent glass or plastic, and may house a lamp interiorly thereof to cast illumination through the member 43 and announce the presence of the telephone stand. Also, diffuse illumination may be cast by the member 43 onto the telephone instrument 35 to facilitate the use thereof.

It may be appreciated from the foregoing description of the preferred embodiment that the telephone stand of the present invention provides a secure, lockable enclosure for a telephone instrument, which is otherwise available for public use. The enclosure is substantially weatherproof, due to the cylindrical dome 43 covering the open end of the pipe, and also due to the fact that the door 24 is greater in length and wider in subtended angle than the window 23.

Most importantly, the curved metal shapes of the present invention which dominate the design thereof provide an extremely strong and durable enclosure, capable of withstanding vandalism and malicious mischief. Also, the use of steel pipe sections as a preferred construction material requires litte tooling or custom fabricated parts. As a result, the telephone enclosure and stand of the present invention may be fabricated and sold inexpensively.

In the foregoing description the present invention has been described with reference to its use with a public telephone. It may be appreciated that the present invention may be employed to equal advantage with other communications equipment, such as police telephones, emergency telephones, fire alarms, and the like.

I claim:

1. A protective telephone stand, including an upwardly extending tubular base member, an upper tubular member secured atop said base member and aligned therewith, a window disposed in said upper tubular member, a curved door disposed in said window in said upper tubular member, pivotting bracket means extending from said door to permit said door to be rotated to occlude or open said window, support means in said upper tubular member for supporting and retaining a telephone instrument, a laterally extending shelf member interposed between said base member and said upper tubular member, and tie rod means extending through and joining said upper tubular member, said pivotting bracket means, said support means, said shelf member, and said base member in compressive fashion.

2. The protective telephone stand of claim 1, wherein said base member and said upper tubular member are fabricated of metal pipe sections.

3. The protective telephone stand of claim 1, wherein said pivotting bracket means includes a pair of pivotting brackets secured to longitudinally opposed ends of said door and extending radially inwardly therefrom, and wherein the upper pivotting bracket is secured to said support means.

4. The protective telephone stand of claim 1, wherein said window includes a pair of opposed, spaced vertical edges, and further including a pair of outwardly extending first flanges, each secured to one of said vertical edges.

5. The protective telephone stand of claim 4, wherein said door includes a vertically disposed second flange extending outwardly through said window and adapted to impinge on either of said first flanges.

6. The protective telephone stand of claim 5, further including means for locking said second flange to either of said first flanges.

* * * * *